United States Patent [19]

Raikamo

[11] Patent Number: 4,815,494

[45] Date of Patent: Mar. 28, 1989

[54] WATER TOWER

[76] Inventor: Mikko H. Raikamo, Vuortentie 1, 60510 Hyllykallio, Finland

[21] Appl. No.: 81,426

[22] Filed: Aug. 4, 1987

Related U.S. Application Data

[63] Continuation-in-part of Ser. No. 934,020, Nov. 24, 1986, abandoned.

[30] Foreign Application Priority Data

Nov. 29, 1985 [FI] Finland ..... 854730

[51] Int. Cl.[4] ..... E03B 11/02

[52] U.S. Cl. ..... 137/593; 137/392

[58] Field of Search ..... 137/391, 392, 568, 571, 137/593

[56] References Cited

U.S. PATENT DOCUMENTS

| | | | |
|---|---|---|---|
| 143,711 | 10/1873 | Pearsons | 137/593 X |
| 803,358 | 10/1905 | Perry | 137/593 X |
| 1,156,532 | 10/1915 | Kieser | 137/568 |
| 2,260,151 | 10/1941 | Miller | 137/593 X |
| 3,102,799 | 9/1963 | Kiekhaefer | 137/593 X |
| 3,201,942 | 8/1965 | Yamamoto | 137/593 X |
| 3,759,286 | 9/1973 | Page | 137/392 |
| 4,380,091 | 4/1983 | Lively | 137/391 X |
| 4,637,424 | 1/1987 | Morgan, III | 137/392 |

FOREIGN PATENT DOCUMENTS

| | | | |
|---|---|---|---|
| 28481 | 2/1903 | Switzerland | 137/593 |
| 0586265 | 12/1977 | U.S.S.R. | 137/593 |
| 0592937 | 2/1978 | U.S.S.R. | 137/593 |

*Primary Examiner*—John Rivell

*Attorney, Agent, or Firm*—Darby & Darby

[57] ABSTRACT

A water tower consisting of a main body extending upward from the ground, a water channel and a pumping means for pumping water into the water channel, which acts as a water storage of the tower. In know water towers, the main water storage is placed at the top of the tower, at a height of several tens of meters, which means that the costs of construction on the tower and its groundwork are considerable and impose strict requirements on the structure of the tower. These problems are solved by the invention in that the tower is provided with a water reservoir placed at its lower end under the ground surface or substantially close to the ground surface, said reservoir constituting a safety storage of water, and that the water channel of the tower is of a substantially narrow sectional form through the whole of its length.

5 Claims, 3 Drawing Sheets

WATER TOWER

CROSS REFERENCE TO RELATED APPLICATIONS

This is a continuation-in-part of U.S. Ser. No. 934,020, filed Nov. 24, 1986, now abandoned.

BACKGROUND OF THE INVENTION

The present invention concerns a water tower consisting of an erect main body, a water channel and a means for pumping water into the channel, which acts as a water storage of the tower.

At present, to create the required pressure in the water distribution network, a structure is employed in which a reservoir constituting a safety storage of water is elevated to a height of several tens of meters above the consumption level. Such structures are often massive in appearance and dominate the landscape of the area. A reservoir like this may have a volume of e.g. a million liters, which means that the water in it weighs a million kg. This imposes very strict requirements on the structure of the reservoir itself, its support and the groundwork. Moreover, since the reservoir is built at an elevated level, it is subject to the effects of the weather, which means that insulation of the reservoir is a problem in cold countries, where the water in the reservoir must be protected against freezing in winter. In most cases, small electric pumps are used for filling the reservoir. The water pressure is created by the height of the tower, and the larger reservoir acts as a safety storage. It is estimated that a full reservoir of water will last e.g. half a day if the consumption is normal. During this time, the pressure in the network falls by 0.5–1 bar, depending on the case (i.e. if the electric pumps are inoperative).

The invention is based on the application to water tower structures of the physical fact that the internal, i.e. hydrostatic pressure of a fluid is only dependent on the difference of height between the point of measurement and the free surface of the fluid, which in this case means the difference of height between the consumption level and the water surface in the tower. In other words, the pressure does not depend on the amount of water in the reservoir, but only on the level of the water surface. It follows that the same pressure can be created e.g. by using a pipe of a small diameter, even just a few centimeters, in which the water is raised to the required level of height.

OBJECT OF THE INVENTION

The following questions are of importance to the constructors and users of a water distribution network:

a. Sufficient water pressure in the network.
b. Sufficient supply of water.
c. Constant pressure.
d. Reliability of operation.
e. Cost of the structures, construction time, viability of the sites, complexity of the technology involved, extendability etc.
f. Appearance of the tower and its adaptability to the surrounding landscape.

These problems are solved by the present invention as follows:

a. A sufficient pressure is achieved by building a tower of the same height as a conventional water tower, but of a considerably "narrower and lighter" structure.

b. A sufficient supply of water is ensured either by buiding a water storage in/on the ground or using a corresponding solution.
c. The water level in the narrow tower is kept at the required height by pumping more water into the tower from a reservoir or other water supply placed in the ground, at a rate corresponding to the rate of consumption. This means that the pumping power is varied with the rate of consumption. In this way the pressure is kept constant, so that the tolerance of variation could be something like +/−0.01 bar. Thus, if the height of the tower were e.g. 40 m, the pressure variation would be 0.2 %, which, considering the variations caused by other factors in the network, is quite insignificant.
d. Reliability of operation is ensured by providing the system with a water storage (reservoir or the like) of a ufficient volume, placed in the ground, and with a separate reserve power system to supply the required energy to the pumps in case of a failure.
e. The tower can be built almost on any kind of ground, the structures are light, there is only little need for thermal insulation and the size of the water storage can be increased if consumption increases. Construction time is short.
f. The structures to be erected overground are of an ordinary type, and the narrow tower will easily fit into the surrounding landscape.

To achieve these objects, the invention is characterized in that the tower is provided with a water reservoir placed at its lower end either underground or substantially close to the ground surface and acting as a safety storage of water, and that the water channel of the tower is of a substantially narrow sectional form through the whole of its length.

An advantageous embodiment of the invention is characterized in that the main body of the tower and its water channel are placed directly above the water reservoir.

BRIEF DESCRIPTION OF THE DRAWINGS

In the following, the invention is described with reference to the drawings attached, wherein.

While the invention will be described in connection with a preferred embodiment, it will be understood that it is not intended to limited the invention to that embodiment. On the contrary, it is intended to cover all alternatives, modifications and equivalents as may be included within the spirit and scope of the invention.

DETAILED DESCRIPTION OF THE PREFERRED EMBODIMENTS

Figure 1:
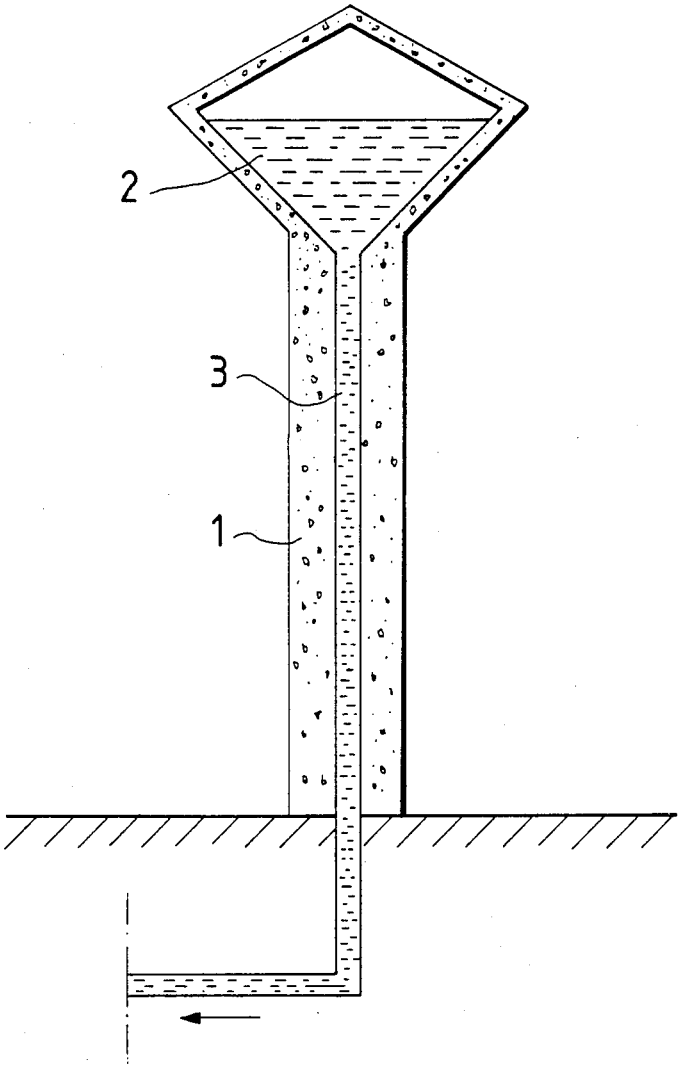
FIG. 1 is a diagram of a conventional water tower.

FIG. 1 shows a conventional water tower consisting of a main body 1 and a water reservoir 2 placed at the top of the tower. Inside the main body is a water channel 3, which is considerably smaller in volume than the reservoir 2. A water tower like this is generally also provided with a pumping means (not shown in the figure), used to replenish the reservoir when necessary.

Figure 2:
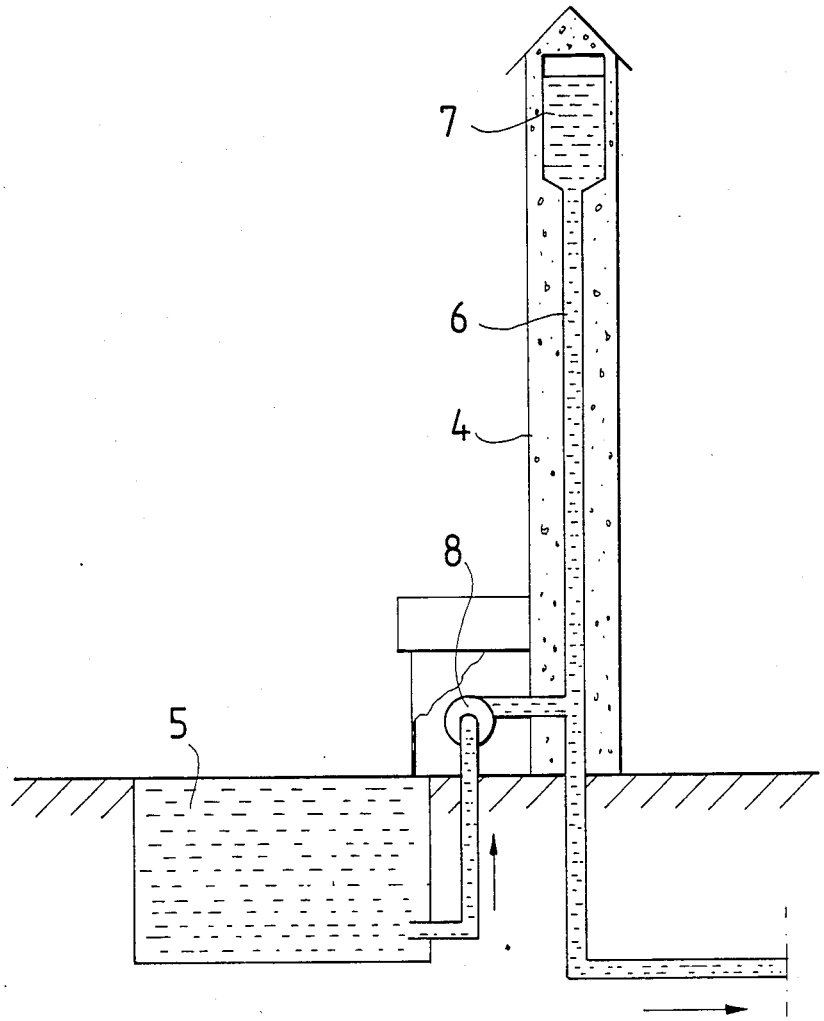
FIG. 2 is a diagram of a water tower as provided by the invention.

FIG. 2 shows a water tower as provided by the invention, in which the main body 4 is substantially of the same height as the conventional water tower but narrow ("thin") in sectional form through the whoe of its length, because the main storage of water, i.e. the water reservoir 5, is placed under the ground surface or in its immediate vicinity. The upper end of the water channel 6 in the embodiment shown in FIG. 2 is provided with a cavity 7 slightly wider in section than the rest of the channel. However, this cavity 7 is considerably smaller than the water reservoirs in conventional water towers and need not necessarily be included in the structure.

"The upper part acting as a water storage of the tower" mentioned in the introductory part of the claim refers to the whole of the water channel 6 as such or the combination of the channel 6 and the small part 7. Naturally, the small part 7 may also be narrower in section than the water channel 6.

The water tower of the invention is provided with a pumping means 8, which is an essential part of the system and is used for pumping water into the tower from the storage or reservoir 5. The level of height of the water surface in the water channel 6, 7 producing the pressure is maintained by pumping more water into the channel 6, 7 from the reservoir 5 on/in the ground. The pumping power is varied according to the consumption in the distribution network in such manner that the surface of the water in the channel producing the pressure remains at the desired level of height with a sufficient accuracy.

It is obvious to a person skilled in the art that the invention is not restricted to the examples of its embodiments discussed above, but that it may instead be varied within the scope of the following claims. Thus, for instance, the water reservoir 5 need not be in the immediate neighbourhood of the tower but may instead be located in a suitable place in the terrain. Also, the reservoir may be placed under the tower, so that the main body and the water channel inside it are directly above the reservoir. Further, it is possible to use a lake, river etc. in place of a reservoir 5.

Figure 3:
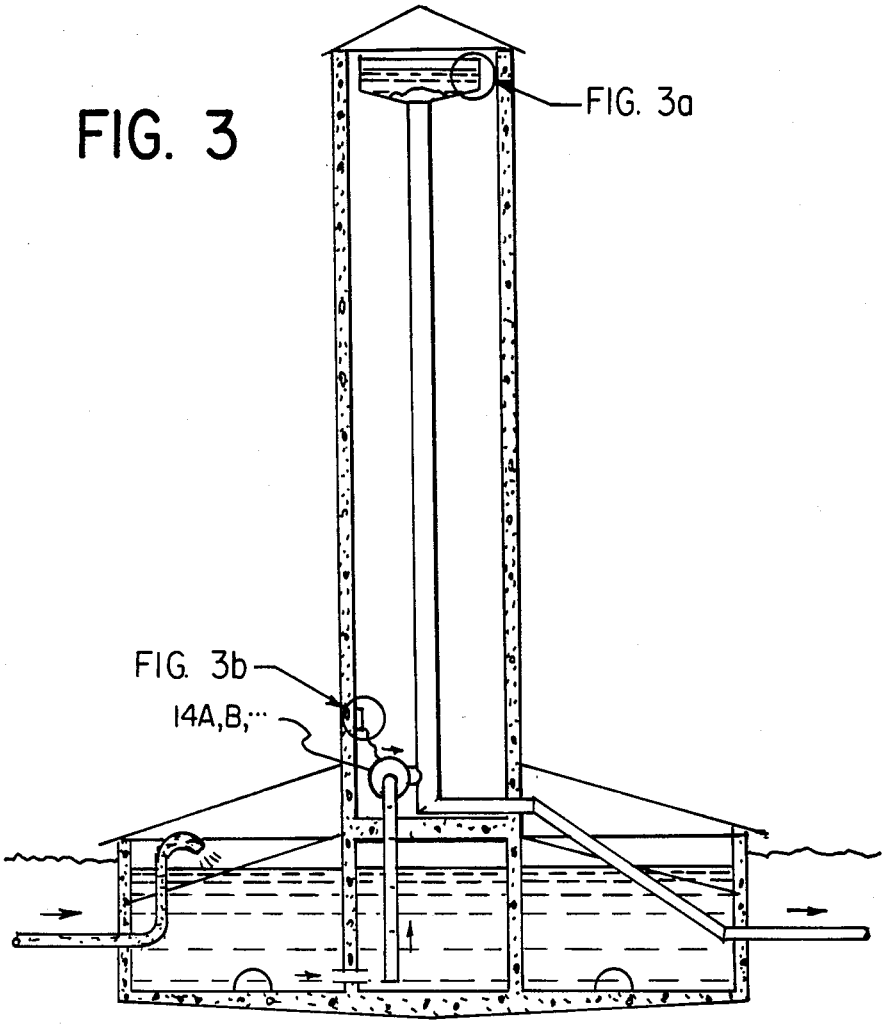
FIG. 3 is another embodiment showing a water tower according to the invention.
Figure 3A:
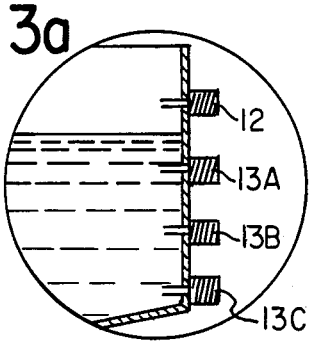
FIG. 3*a* is a detailed view of the element shown in FIG. 3.
Figure 3B:
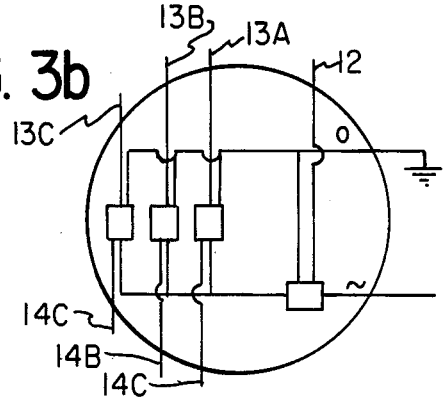
FIG. 3*b* is a detailed view of an element shown in FIG. 3.

In FIG. 3, the reference numeral 12 shows a detector controlling the highest water level in a water tower. The detector may BE an electrical, optical, mechanical or hydraulic switch or sensor, which shuts off the pumping when the water level reaches the level 12. Reference numerals 13A, 13B, 13C show detectors controlling the lowest water level. They start pumping with one or more pumps to add a power of pumping so that a water surface again reaches the level 12.

When pumping is controlled by means of detecting the level of a water surface in the tower, some abrupt pressure shocks caused by changes in the flow cannot disturb the controlling, such disturbance can occur when a switch based on the water pressure is used. For example: if the upper water reservoir is round and its diameter is 4–6 m and $5000 \geqq 10{,}000$ people use the water, the height difference between sensors 12 and 13 may be set to 10cm. Thus, the pressure of the water leaving the tower varies at the most 0.01 bar. Presently pipe nets are used, which burst easily if the pressure in the net varies significantly. This invention substantially reduces the pressure changes within the pipe nets.

Although the present invention has been described with reference to particular embodiments and examples, it will be apparent to those skilled in the art that variations and modifications can be substituted therefor without departing from the principles and true spirit of the invention.

I claim:

1. A water tower comprising a main body extending upwardly from a ground, a water channel and pumping means for pumping water into the water channel acting as a water storage of the tower, the tower having a water reservoir placed at a lower end thereof under the ground surface, said reservoir constituting a safety storage for the water, said water channel having a substantially narrow sectional configuration through the entire length thereof, a detector means for detecting a level of the water in the water channel, pumping means responsive to said detector means and thereby to a change in the level of the water in said water channel for pumping water into the water channel at a rate corresponding to a rate of consumption of water from said water channel so as to keep water pressure in said water channel substantially constant at all times.

2. Water tower according to claim 1, wherein said main body and said water channel are located directly above said water reservoir.

3. A water tower according to claim 1 wherein said detector means comprises a plurality of isolated sensors positioned on an inside surface of the water channel at different elevations.

4. A water tower according to claim 1 wherein said pumping means is formed to keep a variation in water pressure within 0.25%.

5. A water tower according to claim 1, wherein said water channel has an outlet and an inlet which are both arranged below an elevation of said detector means.

* * * * *